US011913742B2

(12) United States Patent
Bender

(10) Patent No.: US 11,913,742 B2
(45) Date of Patent: Feb. 27, 2024

(54) FIRE CONTROL HAMMER SPRING

(71) Applicant: In Ovation LLC, Vadnais Heights, MN (US)

(72) Inventor: Terrence Dwight Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days.

(21) Appl. No.: 17/489,721

(22) Filed: Sep. 29, 2021

(65) Prior Publication Data

US 2022/0099398 A1 Mar. 31, 2022

Related U.S. Application Data

(60) Provisional application No. 63/085,098, filed on Sep. 29, 2020.

(51) Int. Cl.
*F41A 19/14* (2006.01)

(52) U.S. Cl.
CPC ..... *F41A 19/14* (2013.01)

(58) Field of Classification Search
CPC ..... F41A 19/14; F41A 19/42; F41A 19/43; F41A 19/10; F41A 19/15
USPC ..... 42/69.01, 69.03
See application file for complete search history.

(56) References Cited

U.S. PATENT DOCUMENTS

| | | | | |
|---|---|---|---|---|
| 2,775,165 | A * | 12/1956 | Lochhead | F41A 19/45 89/146 |
| 3,197,906 | A * | 8/1965 | Elkas | F41A 19/42 42/69.03 |
| 3,827,171 | A * | 8/1974 | Smith | F41A 19/44 42/17 |
| 7,293,385 | B2 | 11/2007 | McCormick | |
| 7,600,338 | B2 | 10/2009 | Geissele | |
| 8,572,880 | B2 | 11/2013 | Bender | |
| 9,175,918 | B2 * | 11/2015 | Heizer | F41A 19/14 |
| 9,638,485 | B2 * | 5/2017 | Geissele | F41A 19/10 |
| 9,696,103 | B2 | 7/2017 | Bender | |
| 9,863,730 | B2 | 1/2018 | Elftmann | |
| 9,927,197 | B1 * | 3/2018 | Geissele | F41A 19/45 |
| 10,222,161 | B2 | 3/2019 | Bender | |

* cited by examiner

*Primary Examiner* — Reginald S Tillman, Jr.
(74) *Attorney, Agent, or Firm* — Laabs Intellectual Property

(57) ABSTRACT

In some embodiments, a fire control mechanism comprises a frame comprising a flange comprising a peak. A hammer is arranged to pivot about a hammer axis. A hammer spring is arranged to bias the hammer about the hammer axis. The hammer spring contacts the peak of the flange.

17 Claims, 3 Drawing Sheets

FIRE CONTROL HAMMER SPRING

CROSS-REFERENCE TO RELATED APPLICATIONS

This application claims the benefit of U.S. Patent Application No. 63/085,098, filed Sep. 29, 2020, the entire content of which is hereby incorporated herein by reference.

BACKGROUND OF THE INVENTION

This invention relates generally to firearms and more specifically to fire control mechanisms for firearms.

There remains a need for novel fire control designs that provide reliability and longevity benefits over known designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a fire control mechanism comprises a frame comprising a flange comprising a peak. A hammer is arranged to pivot about a hammer axis. A hammer spring is arranged to bias the hammer about the hammer axis. The hammer spring contacts the peak of the flange.

In some embodiments, the hammer spring comprises a leg comprising a bend, and the bend contacts the peak.

In some embodiments, the hammer spring is symmetrical across a bisecting reference plane. In some embodiments, the frame symmetrical across the bisecting reference plane.

In some embodiments, the frame supports the hammer.

In some embodiments, a fire control mechanism comprises a frame comprising a flange comprising a notch. A hammer is arranged to pivot about a hammer axis. A hammer spring is arranged to bias the hammer about the hammer axis. The hammer spring comprises a leg oriented in the notch.

In some embodiments, the flange comprises a first portion, a peak and a second portion oriented nonparallel to the first portion. In some embodiments, the leg contacts the first portion. In some embodiments, the leg comprises a bend and the bend contacts the peak.

In some embodiments, a fire control mechanism comprises a hammer arranged to pivot about a hammer axis and a hammer spring arranged to bias the hammer about the hammer axis. The hammer spring comprises a first leg, a first coil, a loop, a second coil and a second leg. The first leg comprises a first bend and the second leg comprises a second bend.

In some embodiments, a frame comprises a first peak and a second peak. The first bend contacts the first peak, and the second bend contacts the second peak.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
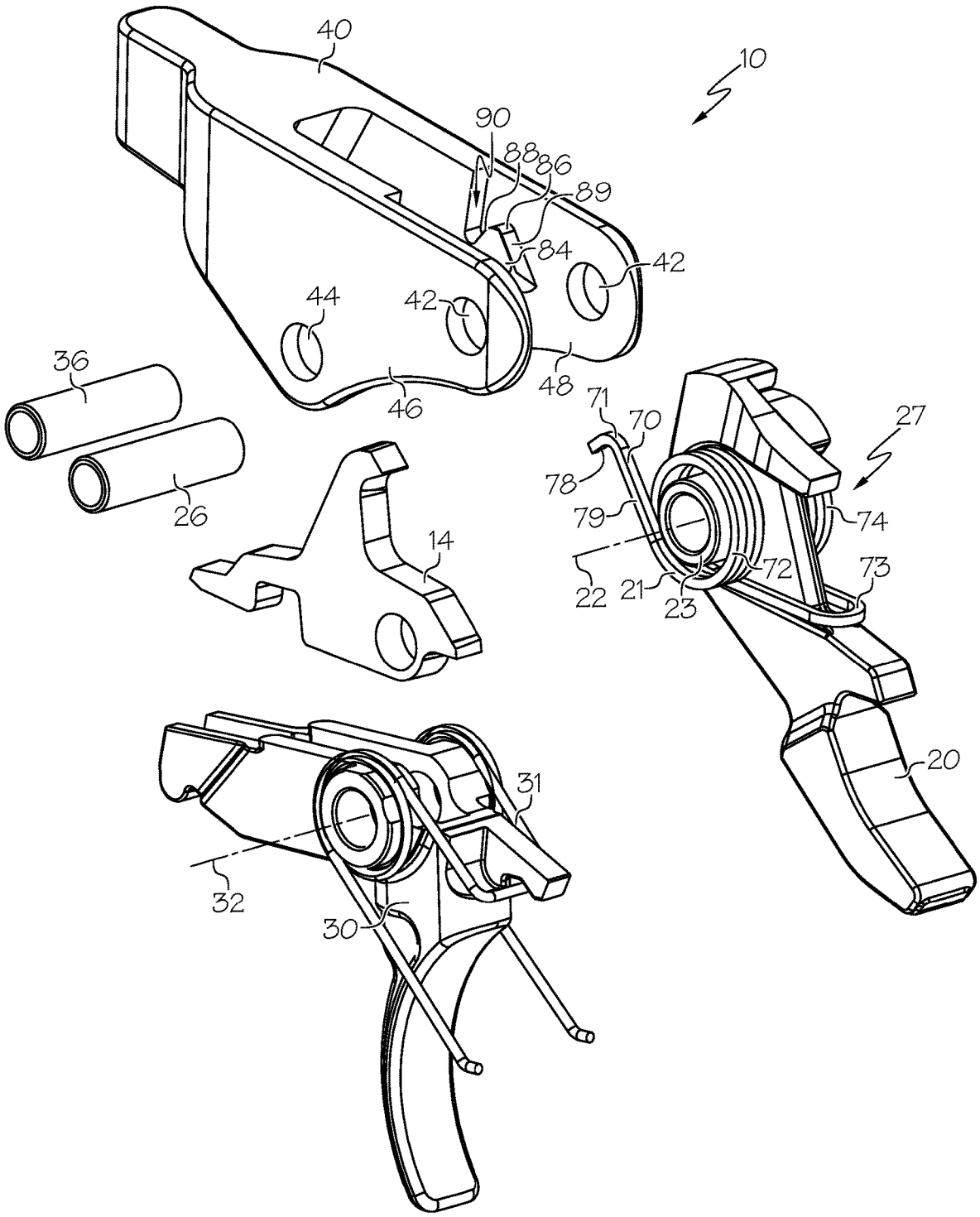
FIG. 1 shows an exploded view of an embodiment of a fire control assembly.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
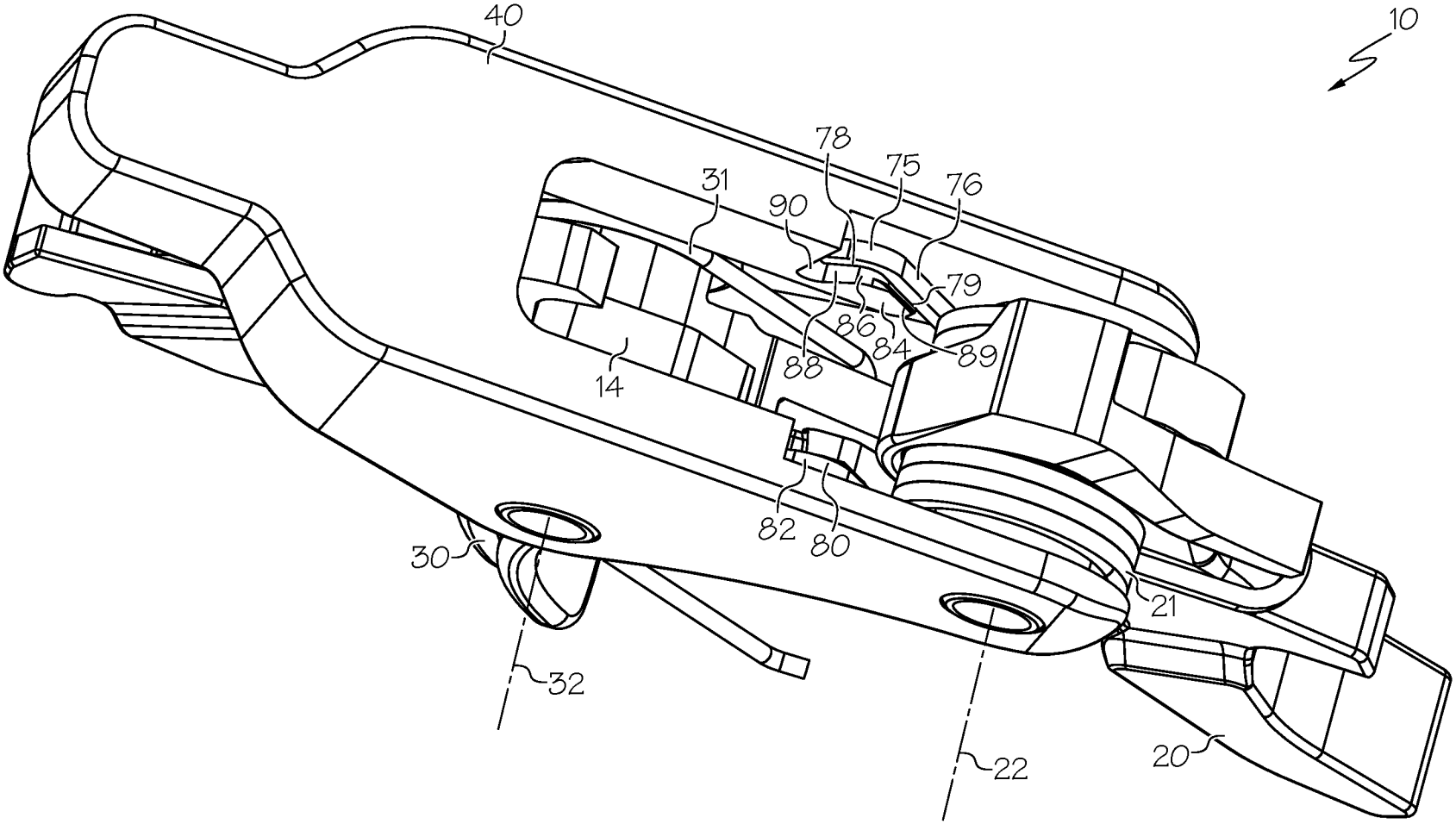
FIG. 2 shows an embodiment of a fire control assembly.
Figure 3:
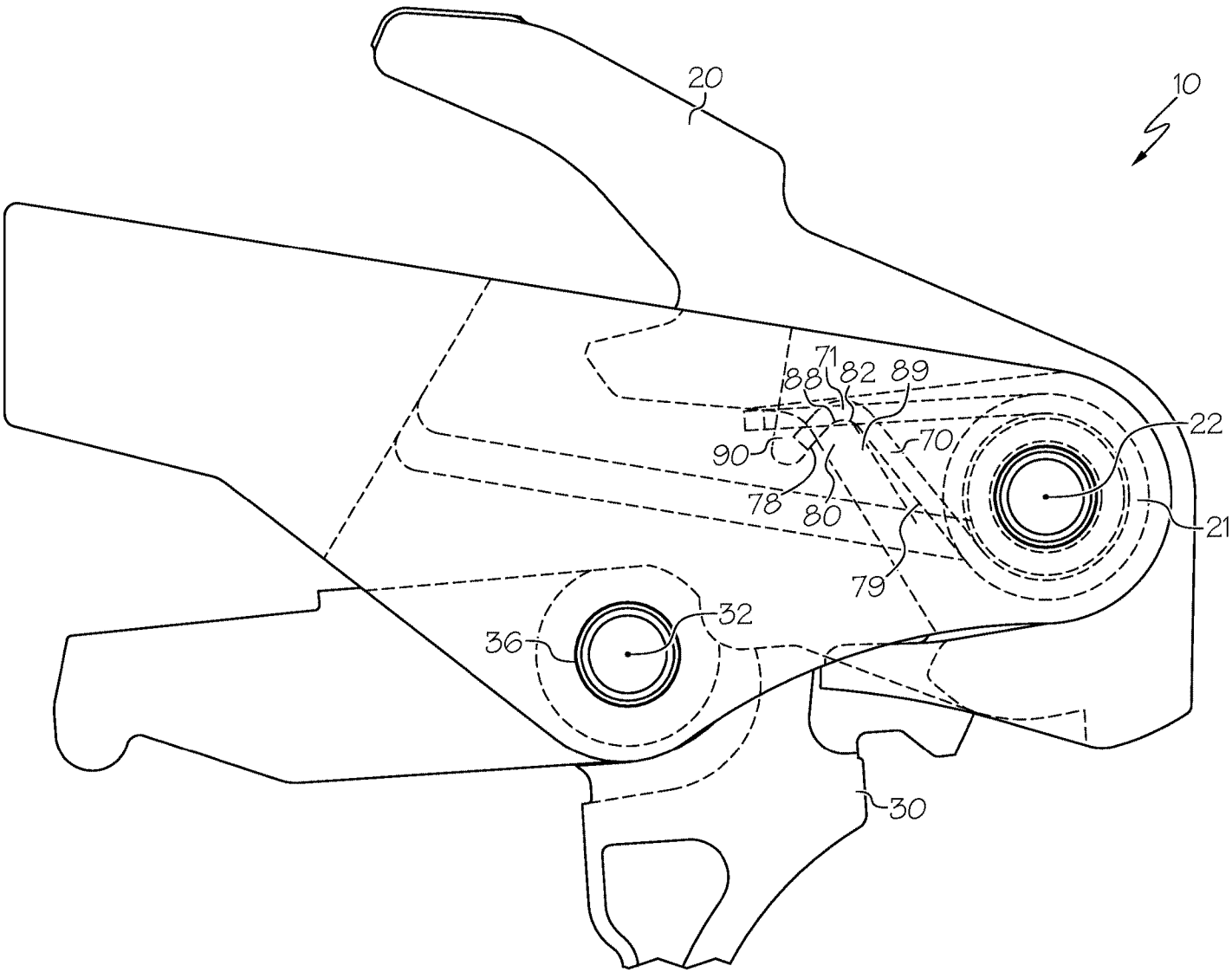
FIG. 3 shows a side view and partial section view of an embodiment of a fire control assembly.

FIG. 1 shows an embodiment of a fire control assembly 10. FIG. 2 shows an embodiment of a fire control assembly 10 in an assembled configuration. FIG. 3 shows a side view of an embodiment of a fire control assembly 10.

In some embodiments, a fire control assembly 10 is suitable for use in an AR-style rifle, for example being suitable for use in an AR lower receiver.

Referring to FIGS. 1-3, in some embodiments, a fire control assembly 10 comprises a trigger 30 arranged to rotate about a trigger axis 32 and a hammer 20 arranged to rotate about a hammer axis 22. In some embodiments, a trigger spring 31 is arranged to bias the trigger 30 in a predetermined direction about the trigger axis 32. In some embodiments, a hammer spring 21 is arranged to bias the hammer 20 in a predetermined direction about the hammer axis 22.

In some embodiments, a disconnector 14 is arranged to move about the trigger axis 32 with respect to the trigger 30.

In some embodiments, the trigger 30 is supported by a trigger axle or trigger sleeve 36. In some embodiments, the trigger sleeve 36 extends through the trigger 30. In some embodiments, the trigger sleeve 36 extends through the disconnector 14.

In some embodiments, the hammer is supported by a hammer axle or hammer sleeve 26. In some embodiments, the hammer sleeve 26 extends through the hammer 20.

In some embodiments, the axles or sleeves 26, 36 are supported by a gun housing (not shown) such as an AR lower receiver. In some embodiments, the axles or sleeves 26, 36 receive fasteners that pass through a sidewall of a gun housing.

In some embodiments, a fire control mechanism 10 comprises a frame 40. In some embodiments, the frame 40 supports the trigger 30. In some embodiments, the frame 40 supports the hammer 20. In some embodiments, the frame 40 supports the trigger sleeve 36. In some embodiments, trigger apertures 44 are provided in the frame 40 that receive the trigger sleeve 36. In some embodiments, the frame supports the hammer sleeve 26. In some embodiments, hammer apertures 42 are provided in the frame 40 that receive the hammer sleeve 26. In some embodiments, the frame 40 comprises a bracket that supports the components of the fire control assembly 10 and is ready for positioning in a gun housing such as an AR lower receiver.

In some embodiments, a hammer spring 21 comprises a first leg 70, a first coil 72, a loop 73, a second coil 74 and a second leg 76. In some embodiments, the hammer 20 comprises a first flange 23 and a second flange 27. In some embodiments, the first coil 72 is positioned to surround the first flange 23 and the second coil 74 is positioned to surround the second flange 27. In some embodiments, a portion of the hammer 20 is oriented in the loop 73, and the loop 73 is arranged to apply a force to the hammer 20. In some embodiments, the first leg 70 bears upon the frame 40. In some embodiments, the second leg 76 bears upon the frame 40.

In some embodiments, the frame 40 comprises a first sidewall 46 and a second sidewall 48. In some embodiments, the sidewalls 46, 48 define a slot 47. In some embodiments, the hammer 20 is oriented in the slot 47. In some embodiments, the trigger 30 is oriented in the slot 47.

In some embodiments, the first sidewall 46 comprises a first flange 80. In some embodiments, the first flange 80 extends inwardly into the slot 47 beyond other portions of the first sidewall 46. In some embodiments, the second sidewall 48 comprises a second flange 84. In some embodiments, the second flange 84 extends inwardly into the slot 47 beyond other portions of the second sidewall 48. In some embodiments, the first leg 70 contacts the first flange 80. In some embodiments, the second leg 76 contacts the second flange 84.

In some embodiments, the first flange 80 comprises a notch 90. In some embodiments, the second flange 84 comprises a notch 90. In some embodiments, the first flange 80 comprises a peak 82. In some embodiments, the second flange 84 comprises a peak 86. In some embodiments, the first flange 80 comprises a first portion 88 and a second portion 89. In some embodiments, the peak 82 is oriented between the first portion 88 and the second portion 89. In some embodiments, a surface of the first portion 88 is oriented at an angle to the surface of the second portion 89. In some embodiments, the second flange 84 comprises a first portion 88 and a second portion 89. In some embodiments, the peak 86 is oriented between the first portion 88 and the second portion 89. In some embodiments, a surface of the first portion 88 is oriented at an angle to the surface of the second portion 89.

In some embodiments, the first leg 70 of the hammer spring 21 comprises a bend 71. In some embodiments, the first leg 70 comprises a hook. In some embodiments, the first leg 70 comprises a first portion 78 and a second portion 79 located on different sides of the bend 71. In some embodiments, the second leg 76 of the hammer spring 21 comprises a bend 75. In some embodiments, the second leg 76 comprises a hook. In some embodiments, the second leg 76 comprises a first portion 78 and a second portion 79 located on different sides of the bend 75.

In some embodiments, the bend 71 of the first leg 70 of the hammer spring 21 is arranged to contact the peak 82 of the first flange 80. In some embodiments, a hook of the first leg 70 is arranged to engage the notch 90 of the first flange 80. In some embodiments, the first portion 78 of the first leg 70 is arranged to contact the first portion 88 of the first flange 80. In some embodiments, the second portion 79 of the first leg 70 is arranged to contact the second portion 89 of the first flange 80.

In some embodiments, the bend 75 of the second leg 76 of the hammer spring 21 is arranged to contact the peak 86 of the second flange 84. In some embodiments, a hook of the second leg 76 is arranged to engage the notch 90 of the second flange 84. In some embodiments, the first portion 78 of the second leg 76 is arranged to contact the first portion 88 of the second flange 84. In some embodiments, the second portion 79 of the second leg 76 is arranged to contact the second portion 89 of the second flange 84.

In some embodiments, the bends 71, 75 or hooks provided in the hammer spring 21 can increase reliability of the hammer spring 21 and extend its service life. As the hammer 20 rotates with respect to the frame 40, the orientation of the loop 73 of the hammer spring 21 changes with respect to the legs 70, 76. Such flexing causes movements in the hammer spring 21. For example, the specific location of the hammer spring 21 may shift in space with respect to the frame 40 and/or the hammer 20. The flexing may also cause shape changes, such a change in the specific size (e.g. diameter) of the coils 72, 74 of the hammer spring 21.

In some embodiments of a hammer spring having straight legs (not shown), the legs may slide on flanges of the frame, which can lead to premature failure of the spring due to undesirable geometries and stresses.

When the legs 70, 76 of the hammer spring 21 are arranged to engage the flanges 80, 84 with a hook or bend 71, 75, movement of the hammer spring 21 with respect to the frame 40 and with respect to the hammer 20 is reduced. For example, the coils 72, 74 of the hammer spring 21 tend to remain tend to remain centered upon the hammer axis 22 when hooks or bends 71, 75 engage the flanges 80, 84.

In some embodiments, contact between the first portion 78 of each leg 70, 76 and the first portion 88 of each flange 80, 84, prevents movement of the hammer spring 21 with respect to the hammer axis 22.

In some embodiments, a first side of the hammer spring 21 is symmetrical with a second side of the hammer spring 21. In some embodiments, the first leg 70 is symmetrical with the second leg 76, for example across a bisecting reference plane. In some embodiments, the frame 40 is symmetrical across the same bisecting reference plane.

U.S. patent application Ser. No. 17/153,787, filed Jan. 20, 2021, and U.S. patent application Ser. No. 17/155,003, filed Jan. 21, 2021, are hereby incorporated herein in their entireties.

The above disclosure is intended to be illustrative and not exhaustive. This description will suggest many variations and alternatives to one of ordinary skill in this field of art. All these alternatives and variations are intended to be included within the scope of the eventual claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims.

The invention claimed is:

1. A fire control mechanism comprising:

a frame comprising a first sidewall and a second sidewall, the first sidewall comprising a flange, the flange comprising a peak;

a trigger support member extending between the first sidewall and the second sidewall;

a trigger arranged to pivot about a trigger axis;

a hammer arranged to pivot about a hammer axis; and a hammer spring arranged to bias the hammer about the hammer axis, the hammer spring contacting the peak, the hammer spring comprising a leg, the leg comprising a bend, the bend contacting the peak.

2. The fire control mechanism of claim 1, the hammer spring comprising a loop and a coil, the loop contacting the hammer, the coil located between the loop and the leg.

3. The fire control mechanism of claim 2, the hammer spring comprising a second coil and a second leg, the second leg comprising a second bend.

4. The fire control mechanism of claim 3, the hammer spring symmetrical across a bisecting reference plane.

5. The fire control mechanism of claim 4, the frame symmetrical across the bisecting reference plane.

6. The fire control mechanism of claim 3, the second sidewall comprising a second flange, the second flange comprising a second peak, the second bend contacting the second peak.

7. The fire control mechanism of claim 1, comprising a hammer support member extending between the first sidewall and the second sidewall, the hammer support member arranged to support the hammer.

8. A fire control mechanism comprising:

a frame arranged for positioning in an AR lower receiver, the frame comprising a flange, the flange comprising a notch, a first portion, a peak and a second portion oriented nonparallel to the first portion;

a hammer arranged to pivot about a hammer axis; and a hammer spring arranged to bias the hammer about the hammer axis, the hammer spring comprising a leg oriented in the notch, the leg contacting the first portion.

9. The fire control mechanism of claim 8, the leg comprising a bend, the bend contacting the peak.

10. The fire control mechanism of claim 8, the hammer spring comprising a loop and a coil, the loop contacting the hammer, the coil located between the loop and the leg.

11. The fire control mechanism of claim 10, the hammer spring symmetrical across a bisecting reference plane.

12. The fire control mechanism of claim 11, the frame symmetrical across the bisecting reference plane.

13. The fire control mechanism of claim 8, the frame comprising a second flange, the second flange comprising a second notch, the hammer spring comprising a second leg oriented in the second notch.

14. The fire control mechanism of claim 8, the frame arranged to support the hammer.

15. A fire control mechanism comprising:

a frame arranged for positioning in an AR lower receiver, the frame comprising a first sidewall and a second sidewall, the first sidewall comprising a first peak and the second sidewall comprising a second peak;

a hammer supported by the frame, the hammer arranged to pivot about a hammer axis; and a hammer spring arranged to bias the hammer about the hammer axis, the hammer spring comprising a first leg, a first coil, a loop, a second coil and a second leg, the first leg comprising a first bend, the second leg comprising a second bend, the first bend contacting the first peak, the second bend contacting the second peak.

16. The fire control mechanism of claim 15, the first leg and first coil symmetrical with the second leg and second coil.

17. The fire control mechanism of claim 1, the frame arranged for positioning in an AR lower receiver.

* * * * *